US010813483B2

(12) United States Patent
Povey

(10) Patent No.: US 10,813,483 B2
(45) Date of Patent: Oct. 27, 2020

(54) DRIP CATCHER FOR STEMMED DRINKING VESSEL

(71) Applicant: David Povey, Warlingham (GB)

(72) Inventor: David Povey, Warlingham (GB)

( * ) Notice: Subject to any disclaimer, the term of this patent is extended or adjusted under 35 U.S.C. 154(b) by 132 days.

(21) Appl. No.: 15/773,598

(22) PCT Filed: Nov. 7, 2016

(86) PCT No.: PCT/GB2016/053466
§ 371 (c)(1),
(2) Date: May 4, 2018

(87) PCT Pub. No.: WO2017/077338
PCT Pub. Date: May 11, 2017

(65) Prior Publication Data

US 2018/0317680 A1 Nov. 8, 2018

(30) Foreign Application Priority Data

Nov. 5, 2015 (GB) ..... 1519583.7

(51) Int. Cl.
*A47G 19/22* (2006.01)
*A47G 23/02* (2006.01)
*B65D 23/06* (2006.01)

(52) U.S. Cl.
CPC ..... *A47G 19/2205* (2013.01); *A47G 19/22* (2013.01); *A47G 23/0216* (2013.01); *B65D 23/065* (2013.01)

(58) Field of Classification Search
CPC ..... A47G 19/2255; A47G 19/2216; A47G 19/22; A47G 23/0216
USPC ..... 220/716, 717, 718, 704, 731; 215/392, 215/393, 394
See application file for complete search history.

(56) References Cited

U.S. PATENT DOCUMENTS 445,569 A * 2/1891 Morningstar ..... B65D 23/065 215/392
2,727,645 A * 12/1955 Dore ..... A47G 23/03 215/393
4,607,758 A * 8/1986 Stevens ..... A47G 19/06 206/509
4,718,594 A * 1/1988 Harazi ..... A23G 9/288 229/932
8,789,541 B1 * 7/2014 Evans ..... A45C 5/005 132/294

(Continued)

FOREIGN PATENT DOCUMENTS

CN 201647253 U 11/2010
DE 886857 C 8/1953

(Continued)

*Primary Examiner* — Jeffrey R Allen
(74) *Attorney, Agent, or Firm* — Ward Law Office LLC; Jacob M. Ward

(57) ABSTRACT

The present disclosure relates to a device for catching liquid content or condensate flowing down the outer surface of a stemmed drinking vessel, for example a wine glass. A device is provided for collecting liquid flowing down the outside surface of a drinking vessel, the drinking vessel having a bowl and a stem, the device comprising an open and substantially conical main body having a slot along its full length such that the device can be fitted around a portion of the bowl proximal to the stem, and snugly around a portion of the stem proximal to the bowl.

19 Claims, 5 Drawing Sheets

(56) References Cited

U.S. PATENT DOCUMENTS

| | | | | |
|---|---|---|---|---|
| 2008/0258031 | A1 | 10/2008 | Cleaver et al. | |
| 2012/0055964 | A1* | 3/2012 | Gluck | A47G 19/2227<br>224/267 |
| 2013/0167868 | A1* | 7/2013 | Brewer | G09F 3/06<br>134/6 |

FOREIGN PATENT DOCUMENTS

| | | | |
|---|---|---|---|
| GB | 2146610 | A | 4/1985 |
| JP | H01151770 | U | 10/1989 |
| WO | 03043894 | A1 | 5/2003 |
| WO | 2015128675 | A1 | 9/2015 |

* cited by examiner

DRIP CATCHER FOR STEMMED DRINKING VESSEL

CROSS-REFERENCE TO RELATED APPLICATIONS

This patent application is a United States National Stage Patent Application of PCT/GB2016/053466, filed Nov. 7, 2016, which in turn claims the benefit of Great Britain Patent Application No. GB1519583.7, filed Nov. 5, 2015. The entire disclosures of the above patent applications are hereby incorporated herein by reference.

FIELD

The present disclosure relates to a device for catching liquid content or condensate flowing down the outer surface of a stemmed drinking vessel, for example a wine glass.

BACKGROUND

Due in part to a difference in temperature between a liquid inside a drinking vessel and the ambient atmospheric temperature, condensation can form on the outside of the vessel. If the vessel is a stemmed vessel, such as a wine glass, the condensation forms in particular on the outside of the bowl part (as opposed to the stem). This condensation runs down the outside of the bowl, down the stem, along the bottom rim of the stem (if present), and finally on to the ground, a table surface, or on to the clothes of the person holding the drinking vessel, for example. If the liquid drips on to a person's clothes, or onto furniture, it can be very inconvenient. Water can leave a mark on certain materials such as silk, and it can also damage wooden tables, for example. Dripping onto a user's skin can also cause an unpleasant sensation.

It is also possible for the liquid that is contained inside the drinking vessel to end up on the outside surface of the vessel. This can occur due to pouring errors, or drinking errors. It is usually the case that the liquid that is inside the drinking vessel can also cause staining to clothes, or damage to other surfaces.

There exist 'drip catchers' that can be fitted around the neck of wine bottles in order to prevent spillage of wine, but these drip catchers are simply made of an absorbent material. This material can itself become saturated and drip.

United States patent application publication number US 2013/0167868 A1 describes an absorbent device for fitting onto the stem of stemmed glassware. However, it should be noted that simply fitting an absorbent material around a wine glass in this way engenders the same problems as the wine bottle drip catchers described above.

What is needed is a means of catching and holding drips from stemmed drinking vessels.

SUMMARY

According to a first aspect, there is provided a device for collecting liquid flowing down the outside surface of a drinking vessel, the drinking vessel having a bowl and a stem, the device comprising an open and substantially conical main body having a slot along its full length such that the device can be fitted around a portion of the bowl proximal to the stem, and snugly around a portion of the stem proximal to the bowl.

The device can comprise a pliable, grippy material selected from: a polyurethane, a polychloroprene, a polyethylene, a thermoplastic elastomer, 'TPE', or a natural rubber material, arranged to substantially return to its original shape after the edges of the slot have been pulled apart, and to prevent slippage of the device down the stem.

An edge of the main body which is proximal to the bowl in use can be extended and angled inwards to form a top rim, the top rim having a plurality of rim protrusions on its surface, the rim protrusions being configured to rest on the outside surface of the bowl, in use, such that liquid can flow between the protrusions into the device.

The main body can comprise a dished portion and a tubular portion having a smaller diameter than the dished portion, configured such that the dished portion fits around the portion of the bowl proximal to the stem, and the tubular portion fits snugly around the portion of the stem proximal to the bowl.

The tubular portion can extend along its length into the dished portion to form an inside rim configured such that, in use, liquid is retained in the dished portion and prevented from flowing into the tubular portion and down the stem of the drinking vessel.

The inside rim can comprise a notch diametrically opposed to the slot.

Edges of the slot at the bottom inner surface of the dished portion can extend upwards to form a lip such that liquid can be retained in the dished portion.

At least a portion of at least one of slot's edges can extend inwards to form a lip.

An end of the tubular portion distal from the dished portion can extend radially inwards to form a lip.

The tubular portion can taper from a smaller internal diameter at an end distal from the dished portion to a larger internal diameter at an end proximal to the dished portion.

The device can further comprise at least one belt configured to bias edges of the slot towards one another so that the device does not slip down the stem in use.

One of the at least one belts can at least partially encircle the exterior of the dished portion.

The belt at least partially encircling the exterior of the dished portion can comprise the rim protrusions, and the top rim can comprise a plurality of apertures corresponding to the plurality of rim protrusions, configured such that each rim protrusion extends through its respective corresponding aperture.

At least one of the at least one belts can at least partially encircle the inside rim.

The belt can comprise a material more rigid than the main body.

The main body can comprise one or more recesses and the belt can comprise one or more corresponding locating protrusions configured to engage with the one or more recesses in the main body.

According to a second aspect these is provided apparatus for collecting liquid flowing down the outside surface of a drinking vessel, comprising the device of the first aspect and an open tubular-shaped absorbent insert having a slot along its full length, configured to fit in between the device and an outer surface of the drinking vessel.

The absorbent insert can be configured to fit between the inside rim, an external wall of the dished portion and the bowl of the drinking vessel.

The absorbent insert can comprise a sponge-like material and/or super-absorbent particles.

According to a third aspect there is provided a method for catching liquid flowing along the outside surface of a stemmed drinking vessel having a bowl and a stem, the method comprising fitting the device of the first aspect around a portion of the bowl proximal to the stem, and snugly around a portion of the stem proximal to the bowl.

The method can further comprising fitting an open tubular-shaped absorbent insert having a slot along its full length in between the device and an outer surface of the drinking vessel.

DRAWINGS

Aspects of the present disclosure will now be described by way of example with reference to the accompanying figures. In the figures.

DETAILED DESCRIPTION

The following description is presented to enable any person skilled in the art to make and use the device, and is provided in the context of a particular application. Various modifications to the disclosed embodiments will be readily apparent to those skilled in the art.

The terms "top", "bottom", "sides" and other terms describing the orientation of features are not intended to be limiting and are purely included in order to facilitate the description of the relative location of these features in the context of the accompanying drawings. In use, or during storage, the features may be disposed in other orientations.

The device described below solves the problem of liquid flowing down the outer surface of a stemmed drinking vessel, e.g. a stemmed glass such as a wine glass, down the stem, and dripping off said surface. The device collects, i.e. catches and retains, liquid flowing down the outer surface of the drinking vessel, such that there is reduced risk of liquid being dripped on to a user, or on to a surface.

The device may be used with stemmed drinking vessels of any shape or size, including but not limited to wine glasses, champagne flutes, brandy glasses, sherry glasses and beer glasses.

The device comprises a substantially conical main body, which is open at both ends of its axis. One end (the top end in use) has a larger diameter than the other end (the bottom end in use). The device may be of varying thickness such that the outside surface of the device is a different shape from the inside surface of the device. It may be desirable for the outside of the device to have a curved shape to provide an ergonomic grip for a user to pick up the drinking vessel with (see for example the examples shown in the figures). The inside of the device may be more angular; such that any liquid can be collected and retained within it (again this is shown in the examples of the figures).

The device includes a slot along its entire length, so that it can be pulled apart and fitted around the stem of a drinking vessel.

The device can have relatively small dimensions so that it sits unobtrusively and discreetly below the bottom of the bowl portion of a stemmed drinking vessel, at the top of its stem.

The device may have surface decoration to make it more aesthetically pleasing. It may have writing on the surface or be branded with a logo, for example.

The device can be dish-shaped at its wide end (the top end in use). It can be more tube-shaped at its narrow end (the bottom end in use). The device can thus be generally funnel-shaped. The dished portion can fit around the bottom of the bowl of the stemmed drinking vessel, and the tubular portion can fit around the stem. The dished portion can have a wider diameter than the tubular portion, as shown in the figures.

Figure 1C:
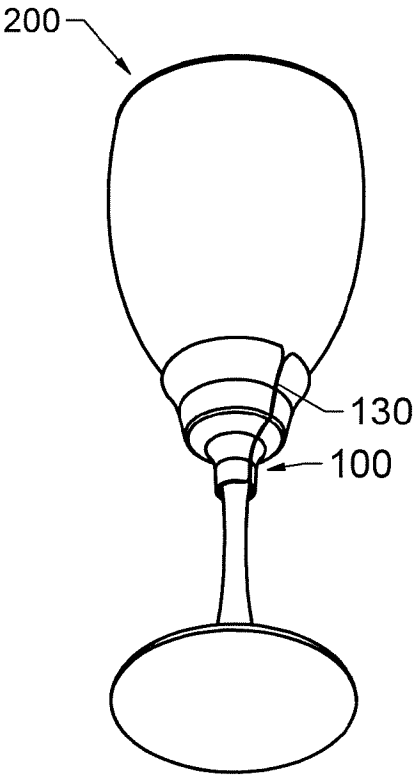
FIG. 1C shows the example device of FIGS. 1A and 1B in use (fitted around a wine glass stem), viewed in perspective slightly from below.
Figure 1B:
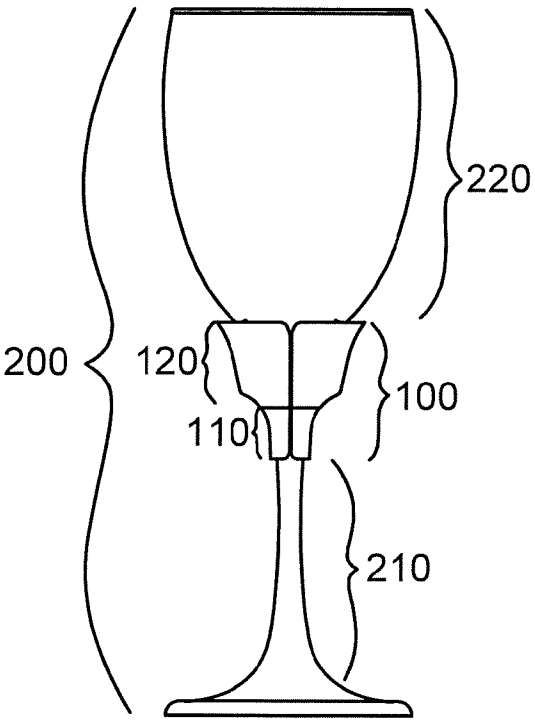
FIG. 1B shows the example device of FIG. 1A in use (fitted around a wine glass stem), viewed side-on with the slot centred.
Figure 1A:
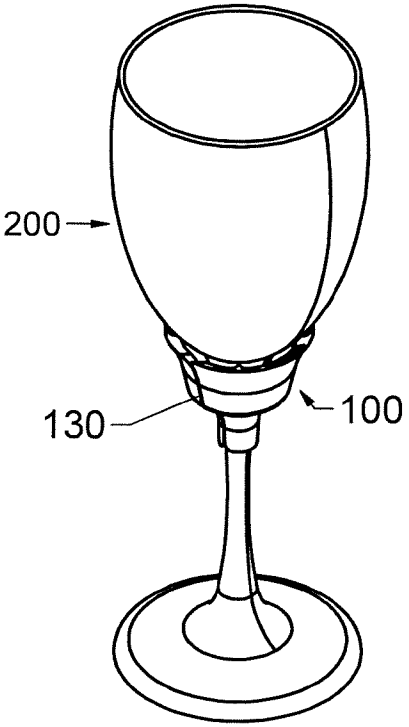
FIG. 1A shows an example device in use (fitted around a wine glass stem), viewed in perspective slightly from above.

As is illustrated by FIGS. 1A, 1B and 1C, a tubular portion 110 of a device 100 fits snugly around a stem 210 of a stemmed drinking vessel 200, such as a wine glass, in use. This facilitates holding of the device in position, with a dished portion 120 of the device just below a bowl 220 of the drinking vessel. Used in this position, the device also acts to thermally insulate the stem from the bowl of the drinking vessel, to prevent condensation from forming on the stem, and thus the stem becoming slippery, as a result of a temperature gradient between a beverage held in the bowl and the surrounding air.

The device is fitted around the stem by pulling apart a slot 130 running all the way down one side of the device.

Figure 2B:
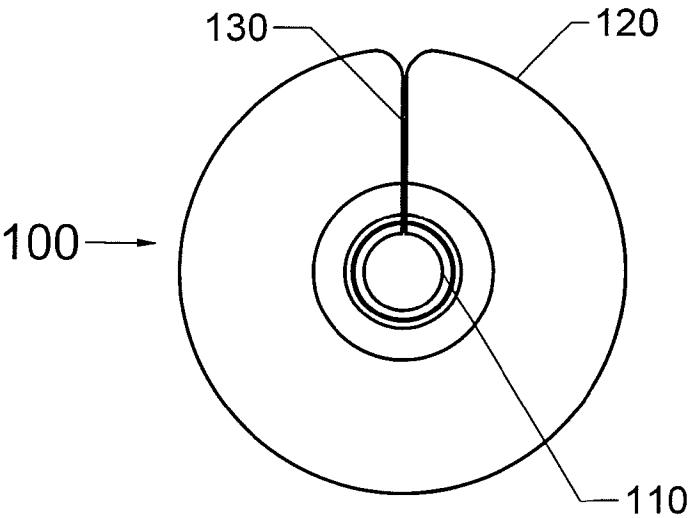
FIG. 2B shows the example device of FIG. 2A, viewed from below.
Figure 2A:
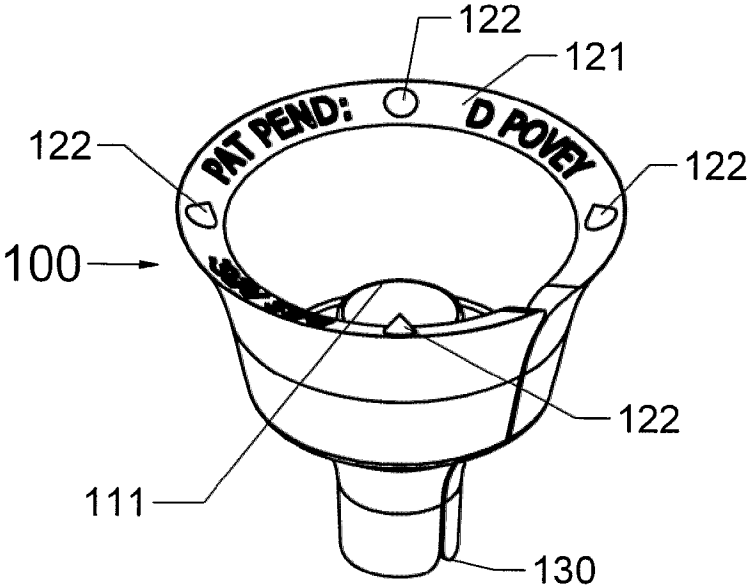
FIG. 2A shows the example device of FIGS. 1A, 1B and 1C, viewed in perspective slightly from above.
Figure 2D:
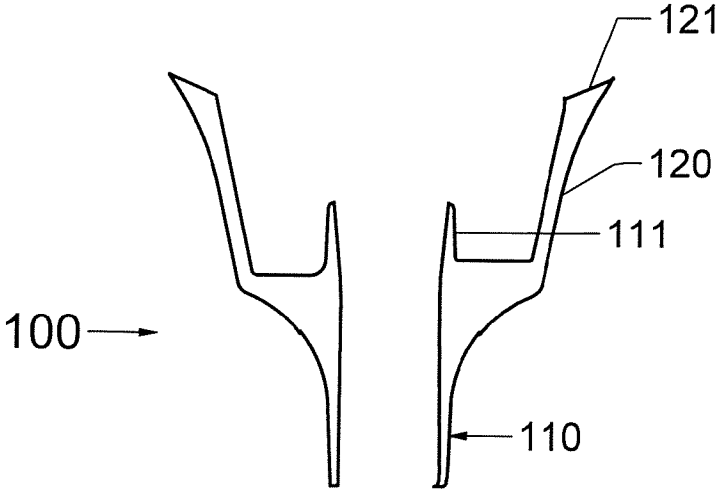
FIG. 2D shows the example device of FIGS. 2A, 2B and 2C, viewed in central cross-section.
Figure 2C:
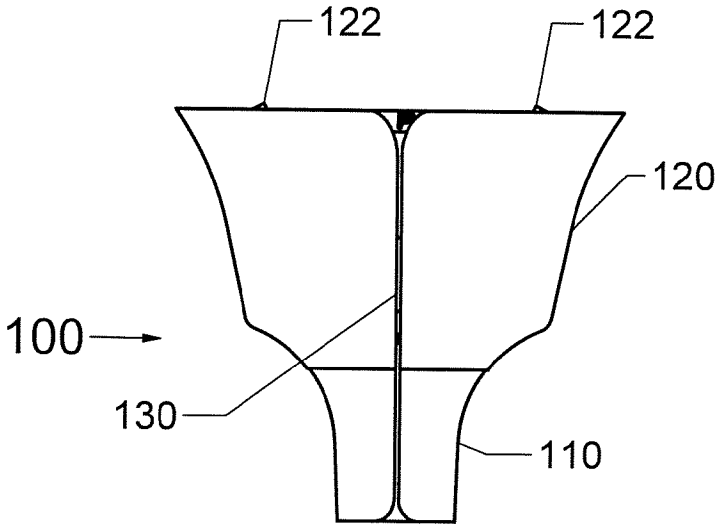
FIG. 2C shows the example device of FIGS. 2A and 2B, viewed side-on with the slot centred.

The top edge of the dished portion can be extended (along the outside surface) and angled inwards to form a top rim 121 as shown in FIG. 2A. This top rim can comprise a plurality of rim protrusions 122 on its surface, such that the rim protrusions can rest against the outside surface of the bowl of the drinking vessel, in use. This results in the top rim of the device being spaced from the surface of the drinking vessel, and means that liquid flows inside the device, in use, rather than down the outside surface of the device.

As shown, a suitable number of rim protrusions is four, though two, three or more than four rim protrusions could be used. The rim protrusions can be arranged in a regular pattern around the top rim, for example with single rim protrusions or pairs of rim protrusions spaced at regular angular intervals around its diameter, to encourage the device to sit levelly under the bowl of the drinking vessel, reducing the risk of liquid collected by the device spilling out of it.

Figure 3A:
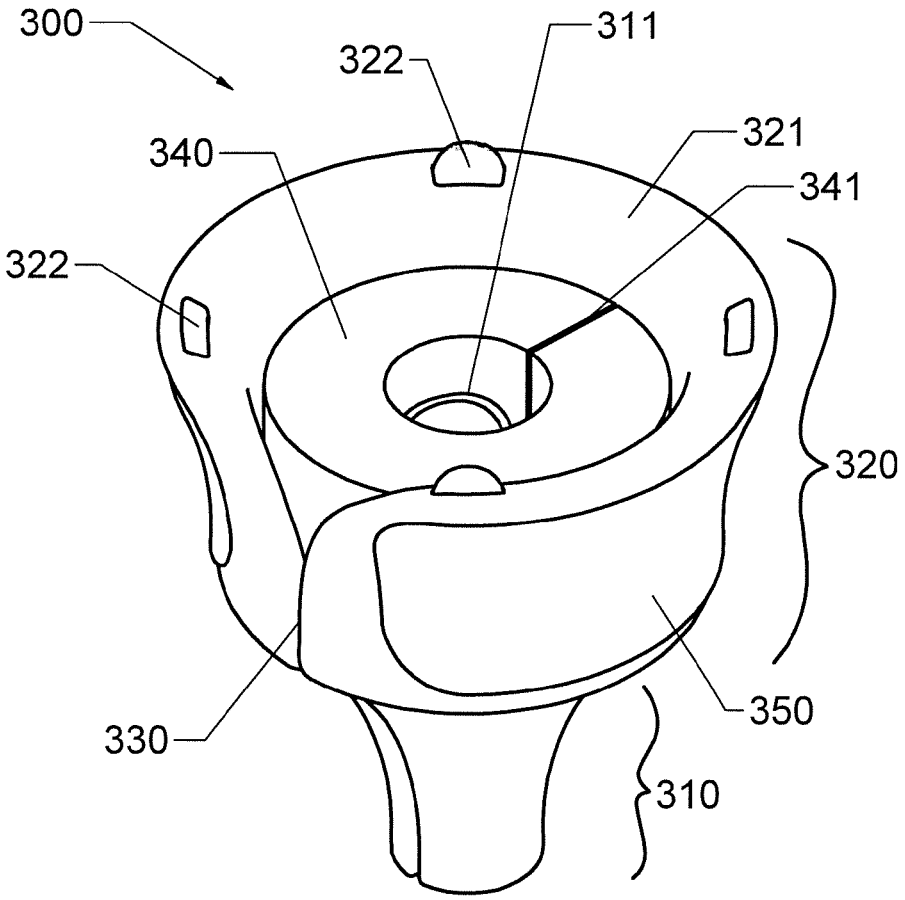
FIG. 3A shows another example device, assembled with an absorbent insert.
Figure 3B:
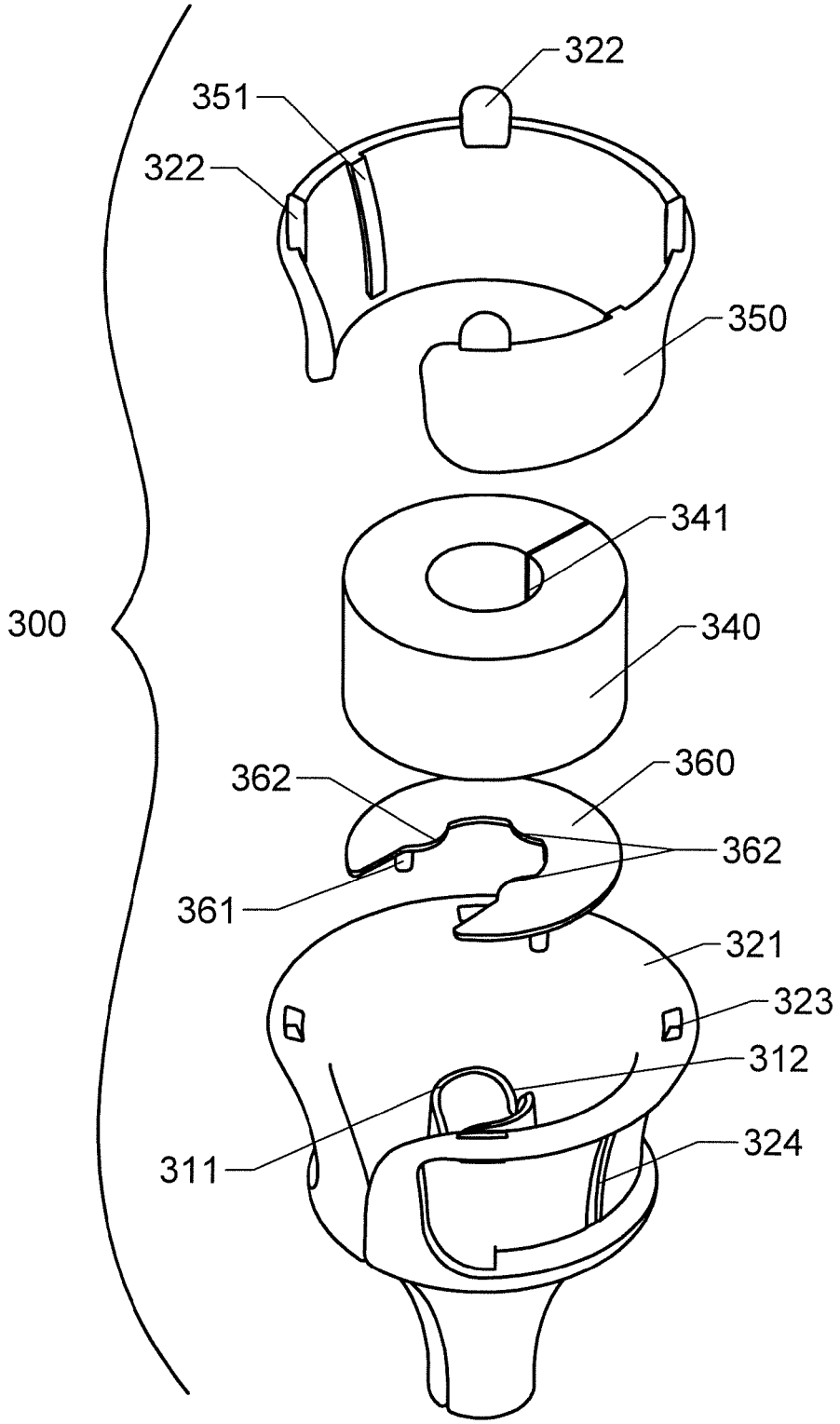
FIG. 3B shows the example device of FIG. 3A in an exploded view to illustrate its components.

Such rim protrusions could be formed of the same material as the top rim. Alternatively, they could be formed of a different, e.g. more rigid, material. For example, they could be upwards extensions of an external relatively rigid plastic belt through apertures in the rim, e.g. as described below and as shown in FIGS. 3A and 3B.

When the rim is angled inwards, towards the surface of the drinking vessel, part of the top rim may become visible to the user in use. There is therefore the option of having a surface design on the top rim, e.g. in between the rim protrusions. This surface is also visible to a user when it is not fitted around a drinking vessel, i.e. when not in use.

As shown in the figures, the device can be shaped such that the top rim sits against the outer surface of the drinking vessel, which in FIG. 1 is a wine glass. The tubular portion of the device fits snugly around the stem of the drinking vessel, such that it forms a substantially liquid-tight seal. The main body of the dished portion (between the top rim and the tubular portion) does not sit flush against the drinking vessel. There should be a space, of e.g. 5 mm to 10 mm, between the inside surface of the main body of the dished portion and the outside surface of the drinking vessel. This facilitates the retention of any liquid that is flowing down the outside of the vessel from above the device. Depending on the shapes of the inside surface of the device and the outside surface of the drinking vessel, this distance will vary.

The tubular portion can extend along its length into the dished portion to form an inside rim 111 such that, in use, liquid is retained in the dished portion and prevented from flowing into the tubular portion and down the stem of the drinking vessel. This also has the advantage of serving to retain an absorbent insert, when present (discussed below).

If the tubular portion extends into the dished portion to form an inside rim then a notch may be provided in its upper edge, diametrically opposed to the slot, for example as will be described below in relation to FIG. 3B. This serves to make the forces exerted by the device on the bottom of the bowl of the drinking vessel more symmetrical, to encourage the device to sit levelly under the bowl of the drinking vessel, reducing the risk that liquid collected by the device will be spilled.

A belt, e.g. in the form of a washer or clip, may be provided to facilitate the retention of the device on a drinking vessel. For example, such a belt could be configured to bias the edges of the slot together so as to retain the device securely at a desired height around a drinking vessel stem. This can also improve the insulating effect of the device. The belt could for example sit externally to the main body of the device, e.g. abutting the lower edge of the tubular portion or at least partially encircling either the tubular or dished portion. Alternatively, the belt could be located internally, e.g. adjacent to the inside rim to force it against the stem of the drinking vessel, in use.

The belt may be provided separately from the device, or it may be integral therewith. It could for example be formed of a shaped wire, e.g. of metal, acting as a spring. Alternatively, the belt could for example be a flat washer, e.g. made of relatively rigid plastic with enough flexibility to permit the device to be pushed onto the stem of a drinking vessel, but also enough resilience to subsequently bias the device to grip the stem. The belt could for example comprise one or more locating protrusions arranged to engage with one or more corresponding recesses on the main body of the device, so as to fix the belt in place. For example, three recesses could be provided in the bottom of the dished portion of the device to receive three corresponding locating protrusions on the underside of the washer. The example device of FIGS. 3A and 3B, described below, comprises two different types of such belts.

The inside bottom surface of the dished portion can be substantially flat such that liquid can be collected on it, in use. This has the advantage of helping to retain liquid in the device. The edges of the slot at the bottom inner surface of the dished portion can extend upwards to form a lip, to aid in retention of liquid in the dished portion.

The edges of the slot along the length of the device can extend inwards to create a flap valve to hold the device in position on the stem. A further, radially inwardly projecting, lip could be provided on the lower edge of the tubular portion to enhance grip on the stem and to act as a further barrier to liquid running down the stem of the drinking vessel.

The device can be made in a variety of sizes, to fit a number of different types of stemmed drinking vessels, for example beer glasses, champagne flutes, brandy glasses and wine glasses. The device could be made to fit a drinking vessel with a very narrow stem, or a drinking vessel with a much wider stem. The diameters of the dished portion and/or tubular portion could be set accordingly.

The tubular portion can be constructed with a tapering internal diameter e.g. 8 mm at the base and 10 mm at the top, such that on pushing the device up the stem towards the bowl, the lower parts help grip the stem to form a substantially water-tight seal. The device can be made to grip further by forming it of certain materials, e.g. using a soft thermoplastic elastomer (TPE) that has inherent grip. The internal tapered diameter of the tubular portion may go from for example 2 mm to 20 mm or greater, e.g. from 8 mm to 10 mm, tapering up from lower to higher diameter, up the stem of the drinking vessel, in use (i.e. from the end of the tubular portion that is distal to the dished portion to the end of the tubular portion that is proximal to the dished portion). The thickness of the tubular portion is preferably designed to act to help grip the stem, for example as a flap valve.

The angle formed between the base of the dished portion and the side wall of the dished portion may be varied. One example is 135°, but it could for example be anywhere between about 90° and 175°.

The device can be made from a pliable material having inherent grip, i.e. it is "grippy" or "tacky" such that the device does not slip down the outside of the drinking vessel. The resilience/elasticity of the device (which may be an inherent property of the material from which is it made or as a result of some modification) can be such that the device substantially returns to its original shape after the edges of the slot are pulled apart (to enable fitting around the stem of a drinking vessel). The device, in particular the dished portion, can be pliable.

As used herein, "inherent grip" or "grippy" means a solid material that has inherent adhesive qualities, and which will therefore not slide easily down the outside of a drinking vessel.

The pliable, grippy material could be a plastics material such as a polyurethane, a polychloroprene, a polyethylene, a TPE, or a natural rubber. The device can be constructed from an appropriate (Shore) grade of TPE, but it could be another material such as hard rubber, or polypropylene, or other plastic material.

It is possible to use an over-moulding process to introduce more than one plastic in the device's construction. For example, the device could be moulded from two separate materials during production (still creating one single device). This is because certain injection moulding processes allow part of the device to be made from one type/strength of plastics material and a second part to be made from a different plastics material, during one cycle of manufacture of the one device. Alternatively, a one-shot moulding process could be used.

It may be beneficial for at least a part of the dished portion to be made of a relatively rigid material and the tubular portion to be made of a more flexible material, for example as described below in relation to FIGS. 3A and 3B. Flexibility of the tubular portion makes fitting and removal of the device easier, and facilitates a tight seal with the stem of the drinking vessel. Rigidity of the parts of the dished portion which will be grasped by the user prevents the user from squeezing liquid collected in the device out of its top. The wider end of the device may be more rigid than the narrower end of the device; this could be facilitated by over-moulding.

While the wider end (or the dished portion) can be made from a substantially rigid material to facilitate retention of the device around the drinking vessel, it should not be so rigid such that the device splits or breaks when the edges of the slot are pulled apart. Therefore, there should also be a degree of flexibility in the device.

This could be achieved for example by providing an external belt (as described above) of relatively rigid plastic around the dished portion of a more flexible main body. For example, the device can be shaped ergonomically so that a user can comfortably use the device to pick up a drinking vessel to which it is fitted, for example with their thumb and forefinger gripping the rigid external clip around the dished portion and their middle finger resting in the upper curve of the tubular portion. An advantage of using a relatively rigid plastic for at least some of the exterior of the device is that rigid plastics tend to be easier to print onto than flexible plastics, allowing the exterior of the device to be decorated and/or used for branding.

Alternatively or additionally, rigidity of the dished portion could be provided using an internal belt as described above, e.g. comprising both a base to fit into the base of the dished portion, and a side wall extending up from the base adjacent the side wall of the dished portion. If the tubular portion extends up into the central part of the dished portion as shown in the figures then such a clip could further comprise an internal wall extending up from the base adjacent the exterior of the part of the tubular portion which extends into the dished portion.

There can also be provided an open tube-shaped absorbent insert member having a slot along its length, which is sized to fit in between the interior of the device and the outer surface of a drinking vessel. This may be provided separately from the device, or it may be integral therewith. In the case where the device has a dished portion and a tubular portion, the absorbent insert can be configured to rest on the bottom inner surface of the dished portion and be retained by the inside rim, if present. In use, the absorbent insert can fit snugly around the stem of a drinking vessel, and can be configured to expand to substantially fill the space between the stem and the inside surface of the dished portion, as it collects liquid.

The absorbent insert is able to absorb liquid, e.g. wine or condensed water. In use, the slot in the absorbent insert can be situated misaligned from, e.g. opposite, the slot in the main body of the device, to minimise leakage from the device. Alternatively, so that the entire device, including the absorbent insert, can be fitted onto the stem of a drinking vessel in one step, the slot in the tubular insert could be aligned with the slot in the main body of the device.

The absorbent insert can be made from a sponge-like material, e.g. pulp fibre, and/or can comprise super-absorbent particles/crystals such as sodium polyacrylate. These materials may be held in a bag, e.g. constructed from non-woven polypropylene. The absorbent insert may be configured to for example absorb 5 to 10 ml of liquid, or more. The absorbent insert may be designed to be single use, and replaceable, preferably without the device of the invention being removed from the drinking vessel. Alternatively, the device overall may be single use. The absorbent insert may alternatively be re-usable, e.g. if squeezed out and/or air dried between uses.

A further example device 300 is illustrated in FIGS. 3A and 3B, shown in an exploded view in FIG. 3B, and assembled in FIG. 3A.

The device of FIGS. 3A and 3B comprises a tubular portion 310 tapering gradually from a relatively small external diameter at its lower edge up into a larger external diameter dished portion 320. The tubular portion extends up inside the dished portion to form an inside rim 311. A slot 330 runs from the top of the dished portion down to the bottom of the tubular portion. The slot 330 is configured such that the device can be pushed onto and pulled off of the stem of a stemmed drinking vessel, with the tubular portion fitting snugly around the stem in use. A notch 312 is formed in the top edge of the inside rim 311, to encourage the device to sit levelly on a drinking vessel in use.

An absorbent insert 340 fits between the inside rim 311 and the internal surface of the dished portion 320. The absorbent insert 340 comprises a slot 341 configured to be pulled apart to allow the absorbent insert to be fitted around, or removed from, the stem of a stemmed drinking vessel. With the slot 341 in the absorbent insert 340 in the orientation shown, i.e. misaligned with (e.g. diametrically opposing) the slot 330 in the main part of the device, fitting and removing the device 300 must be a two-step process as described below. If the slot 341 in the absorbent insert 340 is instead aligned with the slot 330 in the main part of the device, fitting and removal of the device 300 can be achieved in a single action.

The dished portion 320 and the tubular portion 310 are formed of a single piece of flexible, rubber-like material. An outer belt 350 fits around the dished portion to provide some additional rigidity.

The outer belt 350 comprises four rim protrusions 322 spaced at 90° intervals around the upper edge of the outer belt 350. These rim protrusions 322 fit through corresponding apertures 323 in a top rim 321 of the dished portion 320.

The rim protrusions 322 thus extend above the top rim 321 such that they can be pushed up against the bowl of a stemmed drinking vessel to space the top rim 321 of the dished portion 320 slightly away from the bowl of the drinking vessel, allowing fluid running down the exterior of the bowl to run over the top rim 321 into the interior of the dished portion 320, where it can be absorbed by the absorbent insert 340.

The outer belt 350 further comprises internal locating protrusions or ridges 351 configured to engage with corresponding external recesses 324 in the external surface of the dished portion 320. This engagement helps to locate the outer belt 350 in position on the dished portion 320.

Finally, as shown in FIG. 3B, an internal belt 360 fits around the inside rim 311, on the base of the dished portion 320. This component's natural shape, as shown in FIG. 3B, is a relatively open "C", with a relatively wide gap between its two ends. However, the internal belt 360 is made of a relatively rigid, but resilient, material, and so can be squeezed into a more closed "C" shape, with a relatively small gap between its two ends. Three locating protrusions 361 are arranged at approximately 120° intervals around the underside of the internal belt 360 for engaging with corresponding recesses (not shown) in the base of the dished portion 320 to hold the internal belt 360 in the more closed "C" shape. This provides further rigidity to the structure. Three grips 362 extend into the centre of the "C" such that, when the internal belt 360 is located in position, using the locating protrusions 361 and the recesses in the base of the dished portion 320, the grips push on the inside rim 311 to ensure that it grips the stem of the drinking vessel tightly.

As is apparent from FIG. 3B, the device can be assembled by fitting the internal belt 360 into the dished portion 320 and fitting the external belt 350 around the dished portion 320 in either order. The absorbent insert 340 can then be inserted into the dished portion 320 with its slot 341 aligned with the slot 330 in the main part of the device. The assembled device can then be pushed onto the stem of a stemmed drinking vessel. Alternatively, the absorbent insert 340 can be fitted onto the stem of a stemmed drinking vessel; the rest of the device can be fitted lower down the stem, and then pushed up so that the dished portion 320 fits around the absorbent insert 340 and the rim protrusions 322 rest against the exterior of the bowl of the drinking vessel.

Other embodiments will be apparent to those skilled in the art from consideration of the specification and practice of the embodiments disclosed herein. It is intended that the specification and examples be considered as exemplary only.

In addition, where this application has listed the steps of a method or procedure in a specific order, it could be possible, or even expedient in certain circumstances, to change the order in which some steps are performed, and it is intended that the particular steps of the method or procedure claims set forth herein not be construed as being order-specific unless such order specificity is expressly stated in the claim. That is, the operations/steps may be performed in any order, unless otherwise specified, and embodiments may include additional or fewer operations/steps than those disclosed herein. It is further contemplated that executing or performing a particular operation/step before, contemporaneously with, or after another operation is in accordance with the described embodiments.

Alternative Aspects (these are not claims)

1. A device for collecting liquid flowing down the outside surface of a drinking vessel, the glass having a vessel and a stem, the device comprising an open and substantially conical main body having a slot along its full length such that the device can be fitted around a lower portion of the vessel, and snugly around an upper portion of the stem.

2. A device according to alternative aspect 1, which is made from a pliable, grippy material, such that the device does not slip down the outside of the stem but which substantially returns to its original shape after the edges of the slot have been pulled apart.

3. A device according to alternative aspect 1 or alternative aspect 2, wherein the pliable, grippy material is a plastics material such as a polyurethane, a polychloroprene, a polyethylene, or a thermoplastic elastomer, or a natural rubber.

4. A device according to any preceding alternative aspect, wherein the top edge of the main body is extended and angled inwards to form a rim, and which comprises a plurality of protrusions on its surface, such that the protrusions can rest on the outside surface of the vessel, in use, and water can flow in between the protrusions and inside the device.

5. A device according to alternative aspect 1, wherein the main body has a dished portion and a tubular portion having a smaller diameter than the dished portion, such that the dished portion fits around the vessel portion and the tubular portion fits snugly around upper portion of the stem.

6. A device according to alternative aspect 5, wherein the tubular portion extends along its length into the dished portion to form an inside rim such that, in use, liquid is retained in the dished portion and prevented from flowing into the tubular portion and down the stem of the drinking vessel.

7. A device according to alternative aspect 5 or alternative aspect 6, wherein the inside bottom surface of the dished portion is substantially flat such that liquid can be collected, in use.

8. A device according to any of alternative aspects 5 to 7, wherein the edges of the slot at the bottom inner surface of the dished portion extend upwards to form a lip such that liquid can be retained in the dished portion.

9. A device according to any preceding alternative aspect, wherein at least one, preferably both, edges of the slot extends inwards to form a lip along the whole dished portion.

10. A system for collecting liquid flowing down the outside surface of a drinking vessel, comprising a device according to any preceding alternative aspect and an open tubular-shaped absorbent member having a slot along its full length, and which is sized to fit in between the device and the outer surface of the drinking vessel.

11. A system according to alternative aspect 10, wherein the absorbent member is adapted to rest on the bottom inner surface of the dished portion, and sized to substantially fill the space in between the device and the vessel, in use, and which is retained by the inside rim, as described in alternative aspect 6.

12. A system according to any of alternative aspects 10 or 11, wherein the absorbent member is made from a sponge-like material and/or comprises super-absorbent particles.

13. A method for catching liquid flowing along the outside surface of a drinking vessel by fitting a device according to any of alternative aspect 1 to 9 around the drinking vessel.

14. A method according to alternative aspect 13 additionally comprising fitting an open tubular-shaped absorbent member as defined in any of alternative aspects 10 or 11 around the drinking vessel.

15. A device substantially as shown in FIGS. 1 and/or 2.

The invention claimed is:

1. A device for collecting liquid flowing down an outside surface of a drinking vessel, the drinking vessel having a bowl and a stem, the device comprising an open and substantially conical main body having a slot along its full length such that the device can be fitted around a portion of the bowl proximal to the stem, and snugly around a portion of the stem proximal to the bowl, wherein the main body comprises a dished portion for a user to grasp, and a tubular portion having a smaller diameter than the dished portion, wherein the tubular portion is positioned below the dished portion, the main body being configured such that the dished portion fits around the portion of the bowl proximal to the stem, and the tubular portion fits snugly around the portion of the stem proximal to the bowl, the dished portion providing a space above the tubular portion, during use the space being disposed between an inside surface of the dished portion and the outside surface of the drinking vessel for facilitating retention of liquid flowing down the outside surface of the drinking vessel from above the device.

2. The device of claim 1, comprising a pliable, grippy material for providing a liquid-tight seal against the stem, wherein the material is selected from: a polyurethane, a polychloroprene, a polyethylene, a thermoplastic elastomer, TPE', or a natural rubber material, arranged to substantially return to its original shape after the edges of the slot have been pulled apart, and to prevent slippage of the device down the stem.

3. The device of claim 1, wherein an edge of the main body which is proximal to the bowl in use is extended and angled inwards to form a top rim, the top rim having a plurality of rim protrusions on its surface, the plurality of rim protrusions extending above the top rim and being configured to rest on the outside surface of the bowl, in use, such that liquid can flow between the protrusions into the device.

4. The device of claim 1, wherein the tubular portion extends along its length into the dished portion to form an inside rim configured such that, in use, liquid is retained in the dished portion and prevented from flowing into the tubular portion and down the stem of the drinking vessel.

5. The device of claim 4, wherein the inside rim comprises a notch diametrically opposed to the slot.

6. The device of claim 1, wherein edges of the slot at a bottom inner surface of the dished portion extend upwards to form a lip such that liquid can be retained in the dished portion.

7. The device of claim 1, wherein the slot includes edges, and wherein at least a portion of at least one of the edges of the slot extends inwards to form a lip.

8. The device of claim 1, wherein an end of the tubular portion distal from the dished portion extends radially inwards to form a lip.

9. The device of claim 1, wherein the tubular portion tapers from a smaller internal diameter at an end distal from the dished portion to a larger internal diameter at an end proximal to the dished portion.

10. The device of claim 1, further comprising at least one belt configured to bias edges of the slot towards one another so that the device does not slip down the stem in use.

11. The device of claim 10, wherein one of the at least one belts at least partially encircles the exterior of the dished portion.

12. The device of claim 11, wherein an edge of the main body which is proximal to the bowl in use is extended and angled inwards to form a top rim, the top rim having a plurality of rim protrusions on its surface, the rim protrusions being configured to rest on the outside surface of the bowl, in use, such that liquid can flow between the protrusions into the device, wherein the belt at least partially encircling the exterior of the dished portion comprises the rim protrusions, and the top rim comprises a plurality of apertures corresponding to the plurality of rim protrusions, configured such that each rim protrusion extends through its respective corresponding aperture.

13. The device of claim 10, wherein the tubular portion extends along its length into the dished portion to form an inside rim configured such that, in use, liquid is retained in the dished portion and prevented from flowing into the tubular portion and down the stem of the drinking vessel, wherein at least one of the at least one belts at least partially encircles the inside rim.

14. The device of claim 10, wherein the main body comprises one or more recesses and the belt comprises one or more corresponding locating protrusions configured to engage with the one or more recesses in the main body.

15. Apparatus for collecting liquid flowing down the outside surface of a drinking vessel, comprising the device of claim 1 and an open tubular-shaped absorbent insert having a slot along its full length, configured to fit in the space above the tubular portion, in between the device and an outer surface of the drinking vessel.

16. The apparatus of claim 15, wherein the tubular portion extends along its length into the dished portion to form an inside rim configured such that, in use, liquid is retained in the space in the dished portion and prevented from flowing into the tubular portion and down the stem of the drinking vessel, and wherein the absorbent insert is configured to fit between the inside rim, an external wall of the dished portion and the bowl of the drinking vessel.

17. The apparatus of claim 15, wherein the absorbent insert comprises a sponge-like material and/or super-absorbent particles.

18. A method for catching liquid flowing along the outside surface of a stemmed drinking vessel having a bowl and a stem, the method comprising fitting the device of claim 1 around a portion of the bowl proximal to the stem, and snugly around a portion of the stem proximal to the bowl.

19. The method of claim 18, further comprising fitting an open tubular-shaped absorbent insert having a slot along its full length in the space above the tubular portion, between the device and an outer surface of the drinking vessel.

* * * * *